US007427727B2

(12) United States Patent
Koide et al.

(10) Patent No.: US 7,427,727 B2
(45) Date of Patent: Sep. 23, 2008

(54) FIXING APPARATUS AND AN IMAGE FORMATION APPARATUS

(75) Inventors: Hiroshi Koide, Kanagawa (JP); Hitoshi Hattori, Kanagawa (JP); Motokazu Yasui, Kanagawa (JP); Takashi Fujita, Kanagawa (JP); Hirokazu Ikenoue, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 79 days.

(21) Appl. No.: 11/426,155

(22) Filed: Jun. 23, 2006

(65) Prior Publication Data

US 2007/0012676 A1 Jan. 18, 2007

(30) Foreign Application Priority Data

Jul. 15, 2005 (JP) ..... 2005-207062

(51) Int. Cl.
*H05B 1/00* (2006.01)
*G03G 15/20* (2006.01)

(52) U.S. Cl. ..... 219/216; 219/469; 219/470; 219/471; 118/60; 399/328; 399/329; 399/335; 399/338; 432/60; 432/228; 492/46

(58) Field of Classification Search ..... 219/216, 219/469–71; 118/60; 399/328–38; 432/60, 432/228; 492/46
See application file for complete search history.

(56) References Cited

U.S. PATENT DOCUMENTS 6,411,785 B1 * 6/2002 Ogawahara et al. ..... 399/69

FOREIGN PATENT DOCUMENTS

| | | |
|---|---|---|
| JP | 63-313182 | 12/1988 |
| JP | 2-157878 | 6/1990 |
| JP | 4-44075 | 2/1992 |
| JP | 4-204980 | 7/1992 |
| JP | 2727899 | 12/1997 |
| JP | 10-301417 | 11/1998 |
| JP | 11-73050 | 3/1999 |
| JP | 2000-305393 | 11/2000 |
| JP | 2002-373767 | 12/2002 |
| JP | 3567241 | 6/2004 |

* cited by examiner

*Primary Examiner*—Shawntina Fuqua
(74) *Attorney, Agent, or Firm*—Oblon, Spivak, McClelland, Maier & Neustadt, P.C.

(57) ABSTRACT

A fixing apparatus and an image formation apparatus are disclosed. The fixing apparatus includes two or more heaters with temperature detecting function that generate heat with electric current and detect temperature; a heating unit that includes the heater with the temperature detecting function; a film, a surface of which slides on the heating unit; a thermal fixing unit that is heated by the heating unit through the film for fusing a toner image that is yet-to-be fixed on a recording paper at a predetermined fixing temperature; a pressurization roller for pressing the recording paper to the thermal fixing unit; and a temperature control unit for controlling the temperature of the heater to be a predetermined temperature based on the temperature of the heater detected by the heater with the temperature detecting function.

9 Claims, 11 Drawing Sheets

BACKGROUND ART

FIG.5A
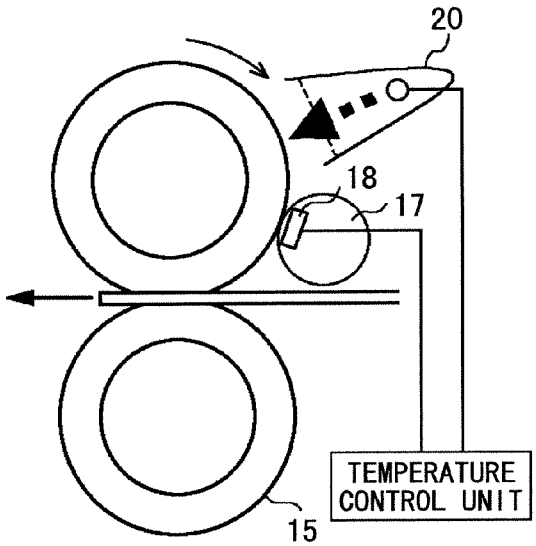
FIG.5B
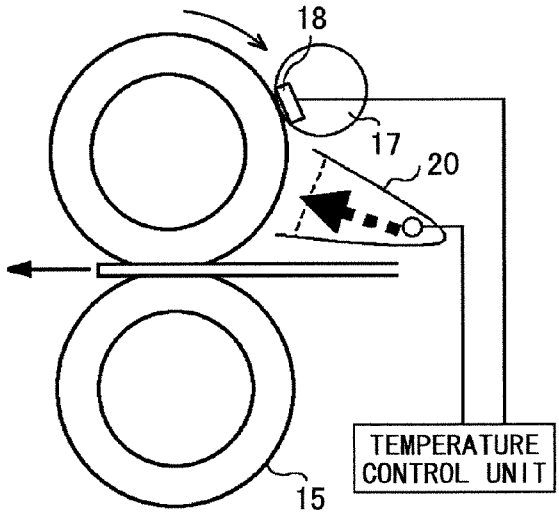
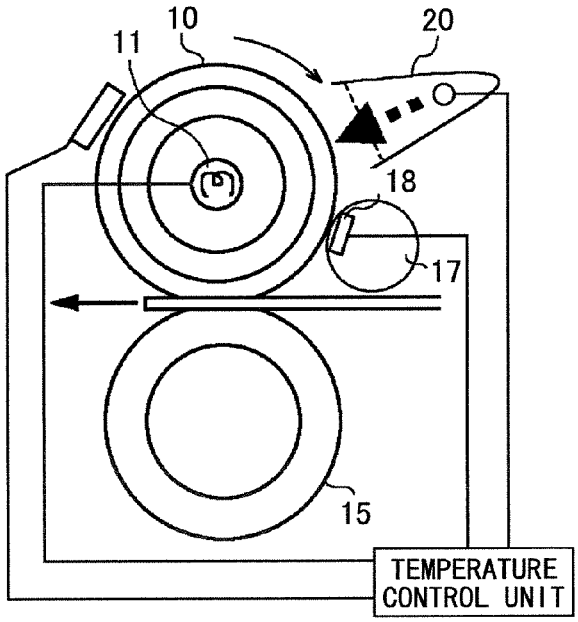
FIG.5C

FIG.7A
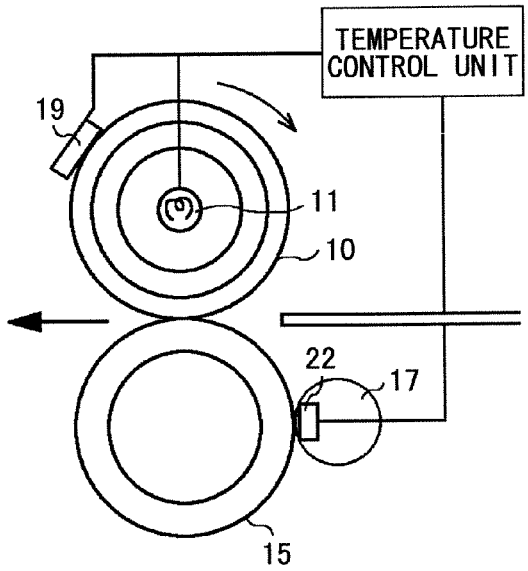
FIG.7B
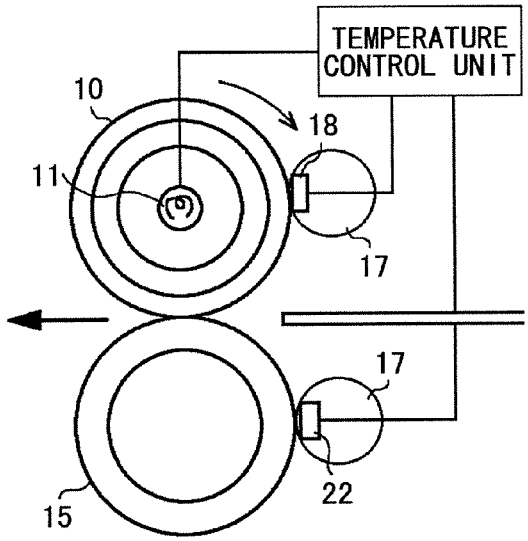
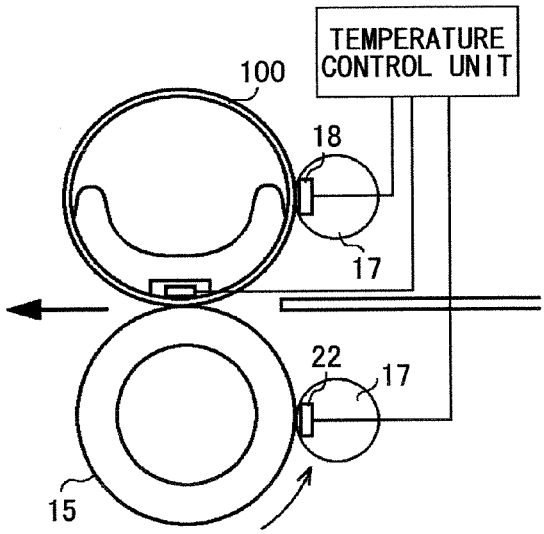
FIG.7C

FIXING APPARATUS AND AN IMAGE FORMATION APPARATUS

BACKGROUND OF THE INVENTION

1. Field of the Invention

The present invention relates to a fixing apparatus and an image formation apparatus.

2. Description of the Related Art

A fixing apparatus is used by an image formation apparatus that is included in, e.g., a copying machine, a printer, a facsimile apparatus, or a compound machine that has at least two of the above functions. The fixing apparatus, which is a thermal fixing apparatus, uses either a heat roller fixing method that provides a high thermal efficiency and safety using a contact-type heating roller, or a film heating method using an energy-saving type film.

The thermal fixing apparatus using the heat roller fixing method includes a heating roller that rotates and is for heating (fixing roller), and an elastic pressurization roller that rotates and makes pressing contact with the fixing roller. The fixing roller and the pressurization roller form a pressing-contact nip (fixing nip). Through the nip, recording paper P that carries a yet-to-be fixed image (toner image), the recording paper P being the target of heating, is conveyed. Heat is applied by the fixing roller and pressure is applied at the nip to the toner image such that the toner image is permanently fixed on the recording paper P.

The heating roller of the thermal fixing apparatus generally includes a metal core having a predetermined thickness, and a layer of an elastic material or a mold-release material provided on the surface of the metal core. Further, a heat source, such as a halogen lamp, is arranged inside the heating roller so that the heating roller is heated from the interior. The metal core is usually made of aluminum because aluminum has excellent processing and thermal conductivity properties.

Recently and continuing, reduction of power consumption is strongly desired due to environmental concerns, while high definition and high speed image production are desired to meet market demand. Then, in order to meet the requirements, various improvements to the fixing apparatus of the heating roller method have been attempted.

[Patent reference 1] JPA 10-301417

[Patent reference 2] JPA 11-73050

[Patent reference 3] JPA 63-313182

[Patent reference 4] JPA 2-157878

[Patent reference 5] JPA 4-44075

[Patent reference 6] JPA 4-204980

One of the improvements is concerning the fixing roller, wherein shortening a temperature rising time and reducing power consumption of the fixing roller are aimed at. There, a heat source is arranged for heating outside surfaces of the fixing roller and the pressurization roller, where only the outside surfaces of the rollers are heated such that the fixing apparatus requires only low power and provides high thermal efficiency. Examples of this improvement are disclosed by Patent References 1 and 2. According to the examples, the heat source is arranged contacting the outside surface of the fixing roller, or alternatively, is contactlessly arranged. Thermal propagation efficiency is higher if the heat source contacts the heating roller. Further, there are types such as one where the heat source is a halogen lamp arranged inside a hollow metal core, and another where an exothermic resistance layer is arranged inside the hollow metal core through an insulating layer of an organic resin (e.g., polyimide), or alternatively, of glass.

Another of the improvements is concerning the film heating method, wherein a heat-resistant film (a fixing film, or simply a film), which is rotationally driven, for heating is stuck to an exothermic body by a pressurization roller (an elastic roller), and sliding conveyance is carried out. Recording paper P (imprint paper) that carries a yet-to-be fixed image (toner image) and the fixing film are conveyed through a pressing-contact nip formed by the exothermic body (heater) and the pressurizing roller (pressurization member) so that the toner image is permanently fixed on the recording paper P by the heat from the exothermic body through the fixing film and the pressure applied at the nip. Examples are disclosed by Patent References 3 through 6.

An example of the film heating method is shown by FIG. 1A, wherein a heater 103 consisting of an exothermic resistance layer formed on a ceramic board made of such as alumina and aluminum nitride is fixed (arranged) to a stay holder (supporting member) 101. Further, a fixing film 100 that is heat-resistant and made of, e.g., polyimide is adhered to the heater 103. Further, a pressurization roller 110 including a metal core 111, an elastic layer 112, and a mold release layer 113 applies force to and contacts the heater 103 through the fixing film 100 to form a nip. The fixing film 100 is rotationally driven by rotation of the pressurization roller 110 and is heated by the heater 103 at the nip. Temperature of the heater 103 is detected by a temperature detecting unit (thermistor) 102 that is attached to the back of the heater 103, and is fed back to a control unit (not illustrated) so that the temperature of the heater 103 is controlled to be a predetermined temperature (fixing temperature). When used in a printer or a copying machine, an image formation apparatus that includes a fixing apparatus of the film heating method has advantages, such as dispensing with pre-heating while in standby and a shortened wait time, due to higher thermal efficiency and faster temperature rising rate than the conventional heat roller method.

Nevertheless, the conventional methods described above have the following problems.

First, according to the heat roller method, the fixing roller has a great heat capacity, and for this reason, a quick start is not available. Further, if an elastic layer, such as silicone rubber, is provided on the fixing roller surface for improvement in speed and quality, the heat capacity is increased and the elastic layer surface has to be heated from the interior of the fixing roller. Accordingly, there is a problem in that wait time is prolonged.

Then, a method of providing a quick start and high quality is proposed as shown in FIG. 1B. Here, an elastic roller using such as silicone rubber is used as a fixing roller 105, and image degradation is reduced while the heat transfer efficiency to the paper is improved by a wrapping effect of the elastic layer. Further, the thermal efficiency is raised by directly heating the surface of the fixing roller by a ceramic heater 107, which is conventionally used by the film heating method, and by using a thin film and a heat insulation backup member as a pressurization member 115. In this way, a quick start is made possible. However, according to the thermal fixing apparatus as described above, since the fixing roller uses the heat insulation elastic material, the heat capacity is less than that of the conventional the fixing roller used by the conventional fixing roller method, which poses a problem in that the fixing roller temperature greatly fluctuates while processing the recording paper. Further, since a heating nip for heating the fixing roller 105 is arranged at the perimeter of the fixing roller 105, there is a problem in that changing the temperature of the fixing roller 105 is delayed, unlike in the case of on-demand fixing where heating is carried out at the fixing nip. Further, it is desired that the pressurization roller 115 provide uniform temperature distribution in order to carry out stable fixing, and for this purpose a width greater than the width of the recording paper P is heated. This poses a problem in that additional power is required.

Next, according to the film heating method, since the thin film having small heat capacity is used and the fixing nip is intensively heated, a quick start is possible; however, temperature control of the fixing nip is difficult. Further, since the thin film is driven by the pressurization roller, film speed tends to be lower than the rotational speed of the pressurization roller, which poses a problem of degrading an image to be fixed.

Furthermore, there is also a problem called an "idle portion temperature rising" phenomenon with the fixing apparatus using the film heating method. That is, when an exothermic body has an "idle portion" where the paper does not pass when printing on small size (width) paper, the "idle portion" is excessively heated, given that the exothermic body almost uniformly generates heat to the maximum paper width of the image formation apparatus, and that the heat is not dissipated by the paper at the "idle portion". Accordingly, when printing on small size paper such as an envelope, since the heat at the "idle portion" is not transferred to the paper, the temperature of the fixing apparatus is excessively raised. Although this phenomenon is also a problem with the fixing apparatus of the conventional heat roller fixing method, the phenomenon is more of a problem with the fixing apparatus of the film heating method. This is because, in order to provide on-demand service, the heat capacity of the exothermic body such as the heating film is made small, and the "idle portion temperature rising" phenomenon notably appears. Therefore, the temperature of the "idle portion" becomes considerably higher, compared to a portion where the paper is processed, after fixing a great amount of small size paper, such as envelopes. If the paper of a usual size (width being near the maximum paper width) is processed under this condition, since the temperature of the "idle portion" is excessively high, "hot offset" is produced in the portion corresponding to the small paper "idle portion", degrading the printing quality.

Conventionally, this problem is solved by reducing throughput, that is, reducing the frequency of printing by extending the paper feed interval. However, the on-demand fixing apparatus of the film heating method is required to provide high speed printing; accordingly, lowering the throughput in order to solve the problem of "idle portion temperature rising" is not a desired solution.

Another method to solve the problem is providing two or more exothermic bodies corresponding to sizes (widths) of the paper to be printed. However, it is conventionally impossible to prepare exothermic bodies corresponding to a great number of paper sizes, or to provide a thermistor to each part.

Further, since heat capacity of the fixing apparatus using the film heating method is small, the temperature has to be finely controlled according to the temperature of the pressurization roller. For example, when the thermal fixing apparatus is started from room temperature, the temperature of the pressurization roller is low; therefore, a greater amount of heat has to be provided. To the contrary, if the temperature of the pressurization roller is high because of immediately preceding fixing operations, heat of the pressurization roller can be transferred to the recording paper P; accordingly, the amount of heat to be provided may be small. For this reason, the fixing apparatus of heating film type includes a thermistor for measuring the temperature of the fixing apparatus so that a proper amount of heat is provided, the thermistor being attached to the exothermic body. The thermistor is often arranged at a place where the paper of any allowed size (width) passes. Accordingly, when small size paper is passed, temperature rising at the "idle portion" is not properly detected. That is, the temperature detected by the thermistor is considerably different from the actual temperature of the fixing apparatus. Further, even if standard size paper is processed, both ends of the exothermic body tend to be cooled faster than central portions; therefore, there is often a difference between the temperature detected by the thermistor and the actual fixing temperature. As described above, if the amount of heat to be provided is determined only by the temperature detected by the thermistor at the paper passing portion, hot offset and poor fixing (cold offset) may be produced.

SUMMARY OF THE INVENTION

The present invention provides a fixing apparatus and an image formation apparatus that substantially obviate one or more of the problems caused by the limitations and disadvantages of the related art.

Features of embodiments of the present invention are set forth in the description that follows, and in part will become apparent from the description and the accompanying drawings, or may be learned by practice of the invention according to the teachings provided in the description. Problem solutions provided by an embodiment of the present invention will be realized and attained by a fixing apparatus and an image formation apparatus particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the present invention provides a fixing apparatus and an image formation apparatus as follows.

PROBLEM(S) TO BE SOLVED BY THE INVENTION

According to an aspect of the present invention, the fixing apparatus includes:

two or more exothermic bodies with temperature detecting function that generate heat with electric current and detect temperature;

a heating unit that includes the exothermic bodies with temperature detecting function;

a film, a surface of which slides on the heating unit;

a thermal fixing unit for heating and fusing a toner image by heat provided by the heating unit through the film at a predetermined fixing temperature, the toner image being yet-to-be-fixed and placed on record paper;

a pressurization unit for pressing the recording paper to the thermal fixing unit; and a temperature control unit for controlling a temperature of the exothermic body to a predetermined temperature based on the temperature of the exothermic body detected by the exothermic body with temperature detecting function.

Further, if an auxiliary heating unit is provided for heating the thermal fixing unit in addition to the heating unit, a better result is obtained.

Further, if the temperature of the auxiliary heating unit is controlled to a predetermined temperature based on the temperature of the exothermic body detected by the exothermic body with temperature detecting function, a better result is obtained.

According to another aspect of the present invention, the fixing apparatus includes:

an exothermic body that generates heat with electric current;

a thermal fixing unit heated by a first heating unit that includes the exothermic body for fusing a toner image on recording paper at a predetermined fixing temperature;

a temperature detecting unit for detecting the temperature of the thermal fixing unit with a sensor;

a pressurization unit for pressing the recording paper to the thermal fixing unit;

a plurality of exothermic bodies with temperature detecting function that generates heat with electric current and detects temperature;

a second heating unit that includes the exothermic bodies with temperature detecting function;

a film, a surface of which slides on the second heating unit;

a paper heating unit for heating the recording paper with the second heating unit through the film;

a temperature control unit for controlling the temperature of the exothermic body to a predetermined temperature based on the temperature of the exothermic body detected by the exothermic body with temperature detecting function included in the second heating unit; and a fixing temperature control unit for controlling a temperature of the thermal fixing unit to a predetermined fixing temperature based on the temperature of the exothermic body detected by the exothermic body with temperature detecting function and the temperature of the thermal fixing unit detected by the temperature detecting unit.

According to another aspect of the present invention, the fixing apparatus includes:

an exothermic body that generates heat with electric current;

a thermal fixing unit heated by a first heating unit that includes the exothermic body for fusing a toner image on recording paper at a predetermined fixing temperature;

a temperature detecting unit for detecting the temperature of the thermal fixing unit by a sensor;

a pressurization unit for pressing the recording paper to the thermal fixing unit;

an exothermic body with temperature detecting function that generates heat with electric current and detects temperature;

a second heating unit that includes the exothermic body with temperature detecting function;

a film, a surface of which slides on the second heating unit, for heating the pressurization unit;

a temperature control unit for controlling the temperature of the exothermic body to a predetermined temperature based on the temperature of the exothermic body detected by the exothermic body with temperature detecting function included in the second heating unit; and a fixing temperature control unit for controlling the temperature of the thermal fixing unit to a predetermined fixing temperature based on the temperature of the thermal fixing unit detected by the temperature detecting unit and the temperature of the pressurization unit detected by the exothermic body with temperature detecting function.

According to another aspect of the present invention, a temperature of each exothermic body with temperature detecting function is controlled depending on a width of the recording paper, providing an improved result.

According to another aspect of the present invention, the temperature control unit includes:

a drive circuit for providing electric current to the exothermic body with temperature detecting function;

a control circuit for switching the electric current provided to each exothermic body between when energizing the exothermic body and when detecting the temperature;

a voltage detection circuit for converting a temperature value of each exothermic body into a voltage value based on the current provided to the exothermic body when detecting the temperature;

an analog-to-digital conversion circuit for converting the voltage value into a digital value; and a comparator for comparing the digital value with a predetermined value.

According to another aspect of the present invention, the temperature control unit includes:

a drive circuit for providing electric current to the exothermic body with temperature detecting function;

a control circuit for switching the electric current provided to each exothermic body between when energizing the exothermic body and when detecting the temperature;

a voltage detection circuit for converting a temperature value of each exothermic body into a voltage value based on the current provided to the exothermic body when detecting the temperature;

an analog-to-digital conversion circuit for converting the voltage value into a digital value; and a comparator for comparing the digital value with a predetermined value.

Further, another aspect of the present invention provides an image formation apparatus that includes the fixing apparatus as described above.

EFFECT OF THE INVENTION

By providing two or more exothermic bodies with temperature detecting function in the longitudinal direction of the roller, the temperature distribution of the roller is accurately controlled, providing the fixing apparatus that is capable of fixing without hot offset or fixing defect.

By providing the auxiliary heater, the temperature can be quickly raised to the desired fixing temperature so that the fixing apparatus is capable of providing high-speed operations.

Further, by controlling the auxiliary heating unit based on the temperature detected by the exothermic body with temperature detecting function, the fixing apparatus is capable of providing both high-speed operations and satisfactory fixing quality.

By heating the recording paper, temperature drop of the roller is reduced, enabling the fixing apparatus to provide high-speed warm-up and high quality fixing without defects, especially where an operating-environment temperature is low.

By heating the pressurization roller, the fixing apparatus is capable of performing higher quality fixing without fixing defects.

By individually controlling power supply to the exothermic bodies with temperature detecting function according to the size (width) of the recording paper P, the fixing apparatus is capable of saving energy, avoiding useless power consumption.

By using the exothermic bodies with temperature detecting function, both heating and temperature detection are performed by the same component, so that the fixing apparatus is capable of performing quick and accurate temperature control.

By using an integrated value of energy of each exothermic body, the fixing apparatus is capable of performing highly reliable and stable fixing of various kinds of toner.

By using the fixing apparatus as described above, the image formation apparatus is capable of providing high quality image formation by smooth fixing operations.

BRIEF DESCRIPTION OF THE DRAWINGS

FIG. 5A is a schematic diagram showing the fixing apparatus that includes the heater with temperature detecting function, and an auxiliary heater;

FIG. 5B is a schematic diagram showing the fixing apparatus that includes the heater with temperature detecting function, and an auxiliary heater;

FIG. 5C is a schematic diagram showing the fixing apparatus that includes the heater with temperature detecting function, and an auxiliary heater;

FIG. 7A is a schematic diagram showing the fixing apparatus using the heat roller fixing method, wherein a pressurization roller is preliminarily heated by a heater with temperature detecting function;

FIG. 7B is a schematic diagram showing the fixing apparatus using the heat roller fixing method, wherein the pressurization roller is preliminarily heated by a heater with temperature detecting function;

FIG. 7C is a schematic diagram showing the fixing apparatus using the film heating method, wherein the pressurization roller is preliminarily heated by a heater with temperature detecting function;

DESCRIPTION OF THE PREFERRED EMBODIMENTS

Figure 2:
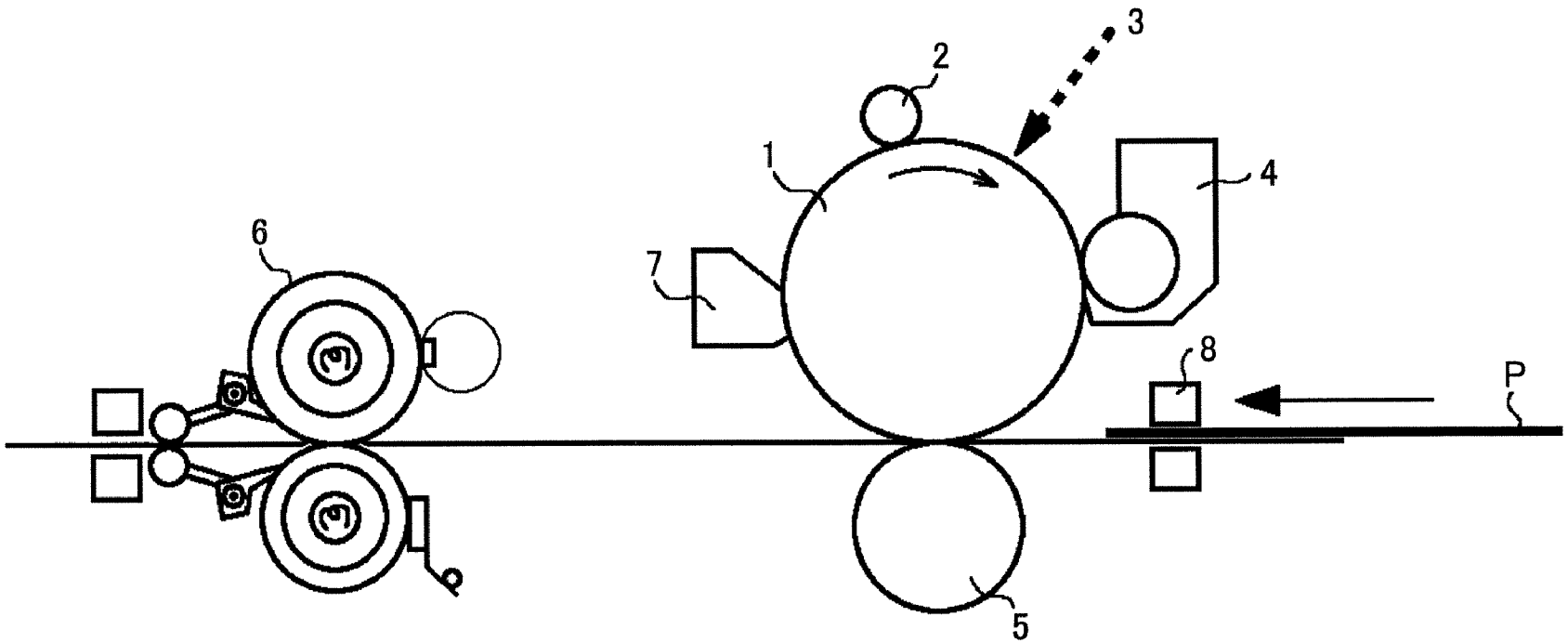
FIG. 2 is a cross-sectional diagram showing the outline of an image formation apparatus according to the present invention.

In the following, Embodiments of the present invention are described with reference to the accompanying drawings. First, an example of an image formation apparatus according to the present invention is described with reference to FIG. 2.

The image formation apparatus includes a photo conductor drum 1 serving as an image supporting object, where photo sensitive material, such as OPC, amorphous Se, and amorphous silicon, is formed on a base made of such as aluminum and nickel in the shape of a cylinder. The photo conductor drum 1 is rotationally driven in the direction of an arrow, and the surface of the photo conductor drum 1 is uniformly electrified (charged) by an electrification roller 2 serving as an electrification apparatus. Next, an electrostatic latent image is formed by scanning a laser beam 3 (optical system is not illustrated) that is turned on and off according to an image to be formed. The electrostatic latent image is developed and made visible by a development apparatus 4, using a development method such as a jumping developing method, a 2-component developing method, and a FEED developing method. It is often that an image exposure and inverting development are combined. The visible image, i.e., a toner image, is transferred from the photoconductor drum 1 to recording paper P conveyed at predetermined timing by an imprint roller 5 serving as an imprint apparatus. Here, conveyance timing of the recording paper P is adjusted so that the toner image formation on the photoconductor drum 1 starts at a proper position of the recording paper P based on a sensor 8 detecting the tip of the recording paper P. The recording paper P is conveyed at the timing between the photoconductor drum 1 and the imprint roller 5 with pressure being applied.

The recording paper P that carries the toner image is conveyed to a fixing apparatus 6, which permanently fixes the toner image on the recording paper P. On the other hand, residual toner that remains on the surface of the photoconductor drum 1 is removed by a cleaning apparatus 7. By repeating the process described above, images are formed one by one.

Figure 3A:
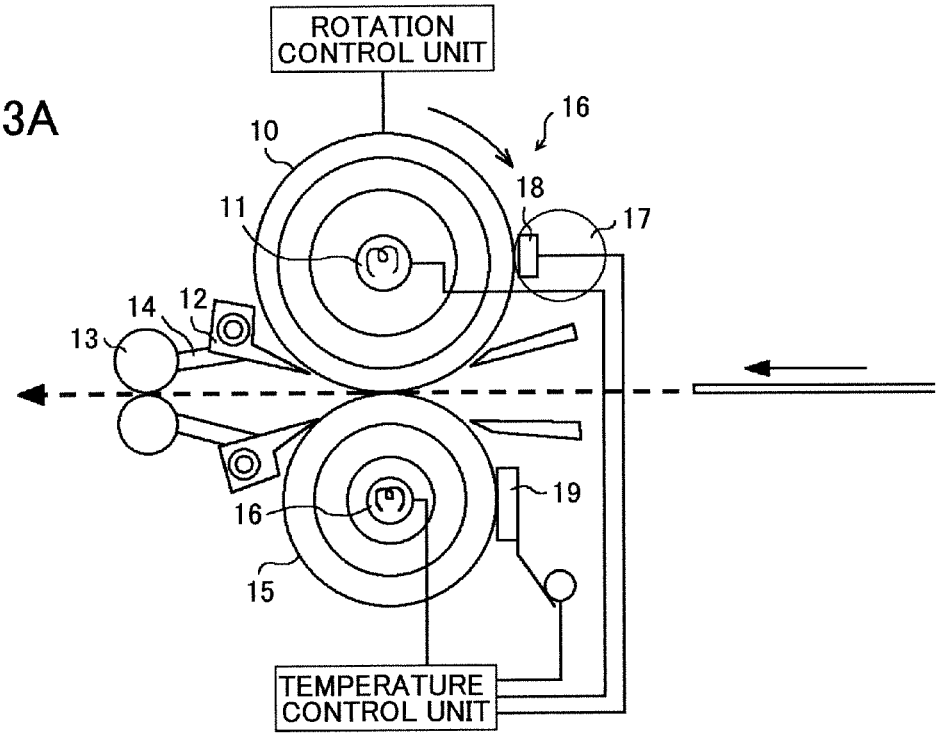
FIG. 3A is a cross-sectional diagram showing a fixing apparatus using a heat roller fixing method.

Now, the fixing apparatus 6 according to the present invention is described with reference to FIG. 3A, which is a vertical cross-sectional diagram showing the conveyance direction (the direction of an arrow) of the recording paper P. The fixing apparatus 6 includes a fixing roller 10, a pressurization roller 15, a heater (halogen lamp) 11 arranged in the fixing roller 10, a heater (halogen lamp) 16 arranged in the pressurization roller 15, a temperature control unit for controlling the temperatures of the fixing roller 10 and the pressurization roller 15, and a rotation control unit for controlling rotation of the fixing roller 10 and conveyance of the recording paper P. The fixing roller 10 includes, for example, a mold-release resin layer, such as PFA and PTFE, on a metal core made of such as aluminum or iron, with its interior heated by the heater 11.

The surface temperature of the fixing roller 10 is detected by a heater 18 with temperature detecting function that is arranged to contact the fixing roller 10, the detected surface temperature serving as the temperature of the fixing roller 10. Based on the detected temperature, the temperature control unit controls turning on and off the heater 18 with temperature detecting function such that the surface temperature is controlled to be a predetermined temperature. The heater 18 with temperature detecting function heats the fixing roller 10 through a film 17, i.e., using a film heating method. The film 17, which is heat-resistant, serving as a rotating heating body is stuck to an exothermic body such as a ceramic heater that includes an exothermic element structured by exothermic paste printed on a heat-resistant ceramic substrate, and a glass coating layer covering the exothermic element for protecting and insulating the exothermic element. The film 17 is conveyed by sliding contact with the fixing roller 10, and provides the heat from the exothermic body of the heater 18 to the fixing roller 10. The film 17 is as thin as 100 μm or less, such that a quick start is available. The film 17 may be of a monolayer made of such as PTFE, PFA, and PPS that have satisfactory durability, thermal resistance, mold release characteristic, and intensity, or a multi-layer film made of such as polyimide, polyamide imide, PEEK, and PES, on which a mold release layer made of PTFE, PFA, FEP, and the like is applied.

On the other hand, the pressurization roller 15 that rotates due to pressing contact with the fixing roller 10 includes a metal core made of such as aluminum or iron, and an elastic layer made of such as silicone rubber or silicone sponge having thermal resistance and a low degree of hardness, the elastic layer being arranged on the metal core. On the surface of the elastic layer, a covering layer made of resin having a high mold release characteristic, such as PFA and PTFE, is provided. The interior of the pressurization roller 15 is heated by the heater 16. The pressurization roller 15 is pressed to the fixing roller 10 by a spring (not illustrated), and is rotationally driven with the film 17 following the rotation of the fixing roller 10 that is driven by the rotation control unit, so that the recording paper P is conveyed. If the heat capacity and thermal conductivity of the fixing roller 10 are made great, heat received at the surface is quickly absorbed, and surface temperature cannot be quickly raised. Accordingly, having a small heat capacity, having a small thermal conductivity, and using a heat-insulating material are desired features of the fixing roller 10 for quickly raising the surface temperature. Although the heat capacity can be desirably made small by reducing the outer diameter of the fixing roller 10, the small diameter can provide only a small heating nip. Accordingly, the outer diameter cannot be made too small, but should be of moderate size. As for the thickness of the elastic layer, if it is too small, heat will easily escape to the metal core; therefore, a moderate thickness is required. These factors being taken into consideration, according to the Embodiment, the outer diameter of the fixing roller 10 is 20 mm and the thickness of the elastic layer made of foam rubber is 4 mm, which provide a proper heating nip and a reduced heat capacity. On the elastic layer described above, a mold release layer made of fluororesin is formed, the fluororesin including perfluoro alkoxy ethylene resin (PFA), poly tetra fluoro ethylene resin (PTFE), or tetra fluoro ethylene-hexa fluoro propylene resin (FEP). The mold release layer may be covered with a tube, or alternatively, may be coated with paint.

The surface temperature of the pressurization roller 15 is detected by a thermistor 19 that contacts the pressurization roller 15, the surface temperature serving as the temperature of the pressurization roller 15. The surface temperature is controlled to be a predetermined temperature by the temperature control circuit turning on and off the heater 16. The heater 16 and the thermistor 19 for the pressurization roller 15 may not be needed depending on requirements.

Further, the recording paper P that supports the toner image is guided by an entrance guide to a nip constituted by the fixing roller 10 and the pressurization roller 15. A nip width in the rotation direction of the fixing roller 10 is such that the toner on the recording paper P is suitably heated and pressed. The rotation control unit includes a motor for rotationally driving the fixing roller 10 and a CPU for controlling the rotation of the motor.

The temperature control unit includes a CPU for controlling power to the heater 11 and the heater 16 based on temperatures detected by the heater 18 with temperature detecting function and the thermistor 19, respectively. Especially, the heater 18 with temperature detecting function includes the exothermic body with a temperature detecting device generally called a thermistor wherein a resistor, the resistance of which changes with exothermic temperatures, is used. Metal composition of the thermistor is determined such that an amount of the exothermic temperature change and an amount of resistance change are in linear proportion as much as possible. For example, an alloy of aluminum, chromium, boron, etc., is used.

Compared with common thermistors, the amount of the exothermic temperature change and the amount of resistance change of the heater 18 with temperature detecting function have a proportional relationship. For this reason, transiting between a heating mode where a current flows for heat generation and a measuring mode where the thermistor resistance is measured can be swiftly performed. That is, the heater 18 with temperature detecting function is capable of heating and temperature measuring by turns with the same element. Accordingly, if the measured temperature of the surface of the fixing roller 10 at a position illustrated has not reached a predetermined fixing temperature, the same position can be heated. Accordingly, even if heat is transferred to the recording paper P as it passes through the nip and the surface temperature of the fixing roller falls, the temperature fall is immediately detected, and the position is heated. The temperature of the fixing roller 10 is controlled in this way.

Further, the temperature detected by the heater 18 with temperature detecting function can be used to control the exothermic drive of the heater 11 and the heater 16 by comparing a digital value representing the detected temperature with a predetermined digital value.

Further, it is possible to compare a value obtained by instantly integrating energy from the value of the detected temperature with a predetermined value for controlling. That is, digital values representing the temperatures measured by the heater 18 with the temperature detecting function are added up from the time of heating start, and the added up value is compared with a predetermined value for controlling the exothermic drive of the heater 11 and the heater 16. In this way, when fixing viscoelastic toner having a high temperature-dependency, a thermal energy value that can contribute to deformation of the toner can be controlled.

Then the recording paper P carrying the toner image is conveyed to the fixing apparatus 6, and the toner image is heated and pressed in the fixing nip to become a permanent image. Then, the recording paper P is separated from the fixing roller 10 and the pressurization roller 15 by a separation nail 12, guided to a separation roller 13 by a separation guide 14, and discharged out of the image formation apparatus.

Figure 1A:
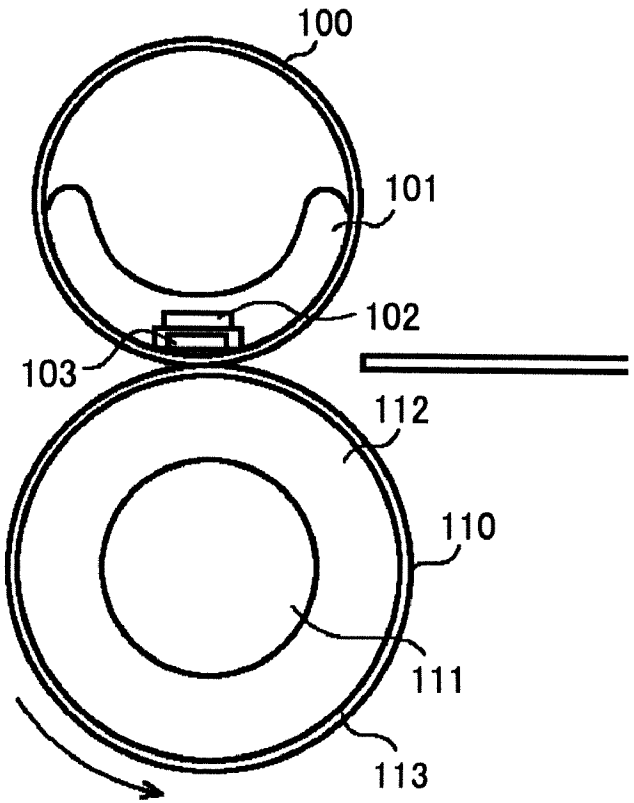
FIG. 1A is a cross-sectional diagram showing a conventional fixing apparatus using a film heating method.
Figure 1B:
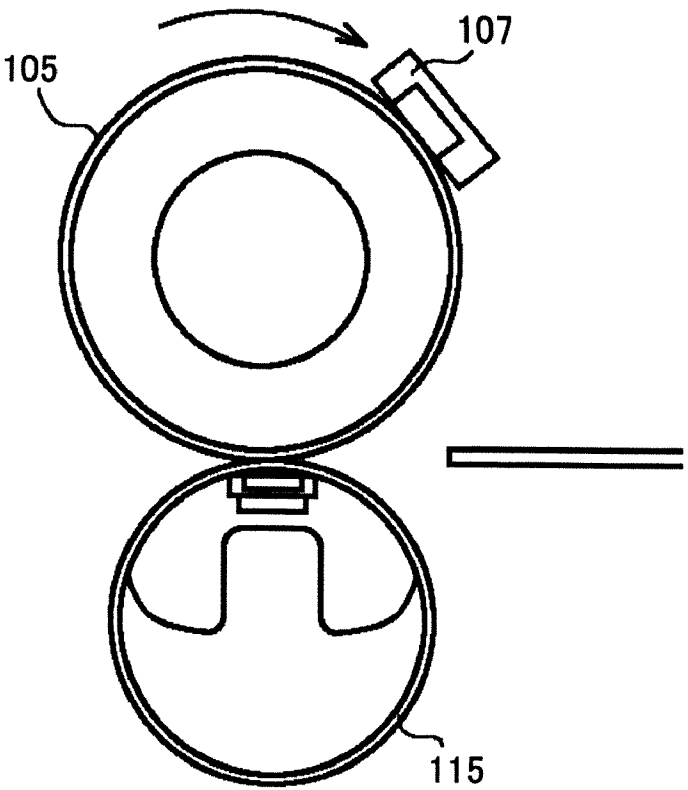
BACKGROUND ART FIG.1B
FIG. 1B is a cross-sectional diagram showing a conventional fixing apparatus using another film heating method.
Figure 3B:
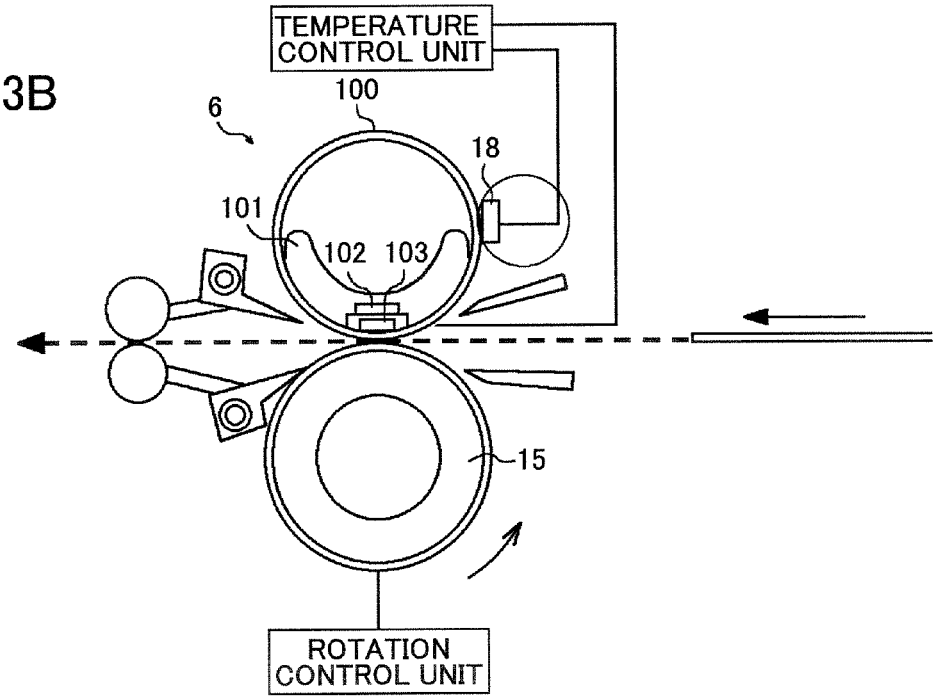
FIG. 3B is a cross-sectional diagram showing a fixing apparatus using a film heating method.

The fixing apparatus 6 shown in FIG. 3B is a case where the thermal fixing is carried out by the film heating method. Here, there is no heating unit provided for the pressurization roller 15 that is rotationally driven, but the heater 103 and the heater 18 with temperature detecting function provide heat for thermal fixing. In addition, the configuration shown by FIG. 3B includes the fixing film 100, the stay holder 101, the temperature detecting unit 102, and the heater 103 as shown in FIG. 1. Further, a heater may be provided for the pressurization roller 15 and made into a controlling target.

Figure 4:
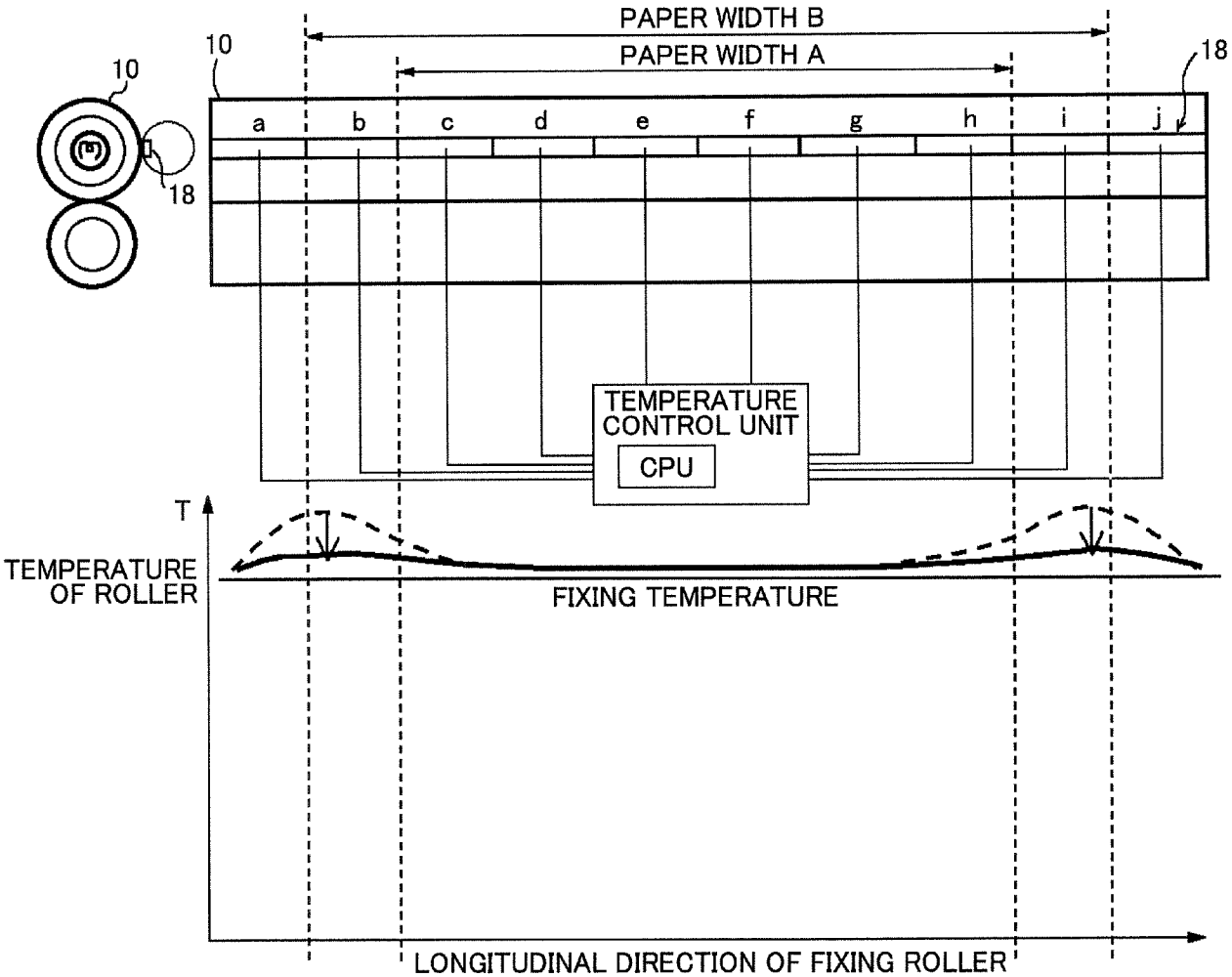
FIG. 4 is a schematic diagram showing a heater with temperature detecting function arranged in width directions of recording paper P.

FIG. 4 shows the heater 18 with temperature detecting function that is divided into ten pieces in directions perpendicular to the recording paper P conveyance direction.

Here, the pieces are arranged in a line with each piece having an exothermic body and the control as described above is performed independently for all the exothermic bodies.

Since heating is controlled with the structure described above, the problem of "idle portion temperature rising" is avoided, the "idle portion" being outside of an area delimited by dotted lines in FIG. 4. Since the temperature is controlled on a block-by-block basis, a uniform temperature distribution is obtained and stable fixing is available. Although the Embodiment uses 10 blocks, the number of blocks is not limited to this. Since the accuracy of the detected temperature of a block increases as the number of the blocks is made greater, a more even distribution of temperature after controlling can be obtained. According to the Embodiment, good printing on regular-size paper was obtained without a hot offset occurring after having continuously printed 100 envelopes of a smaller size. Further, since heating is selectively carried out in accordance with the size the recording paper P, power efficiency is improved, high quality fixing is obtained, and energy-saving is attained. Where the recording paper P is size A (e.g., vertical A4), the exothermic drive (heating) and the temperature detection are carried out for blocks from c to h. Where the recording paper is of a size B (e.g., vertical A3), the exothermic bodies from b to i are used.

The paper size (width) may be determined based on a paper size signal provided by an external computer (not illustrated) at the time of printing, or based on a signal from a sensor for detecting the paper width, the sensor being provided on the fixing apparatus.

Further, automatic detection of the paper size is available using the configuration and the integrated energy value described above. (When the automatic detection is used, the sensor for detecting the paper width can be dispensed with.) For example, when the same size of the recording paper P is continuously printed (fixed), all the exothermic bodies over the longitudinal direction of the heater are turned on for the first few sheets in the beginning. Then, integrated power consumption of exothermic bodies that correspond to the width of the recording paper becomes greater than those for the "idle portion" because heat is taken away by the recording paper P and corresponding heaters are turned on to restore the temperature. In this way, the paper width can be determined, and then the exothermic bodies corresponding to the "idle portion" are turned OFF. When printing in large quantities, paper width detection is carried out by printing only several sheets in the beginning. That is, the power control by the automatic paper width detection is attained, and an effect of energy saving is expected.

FIGS. 5A, 5B, and 5C show configurations that include an auxiliary heater 20 for quickly attaining a desired temperature, in addition to the heater 18. As the auxiliary heater 20, a halogen lamp, IH, and the like can be used. It is desired that that auxiliary heater 20 be structured such that heat is efficiently radiated in a desired direction. In this case, too, highly precise control is attained by feeding back the temperature detected by the heater 18 with temperature detecting function. Further, even when the rotational speed of the fixing roller 10 is raised for high-speed operations, a desired fixing temperature can be quickly reached, enabling shortening warm-up time. FIG. 5C shows the case where the auxiliary heater 20 is used for the conventional fixing roller 10 having the halogen heater 11. Here, too, if two or more heaters 18 with temperature detecting function are provided in the longitudinal direction of the roller as shown in FIG. 4, temperature fall of the "idle portion" can be quickly restored.

Figure 6A:
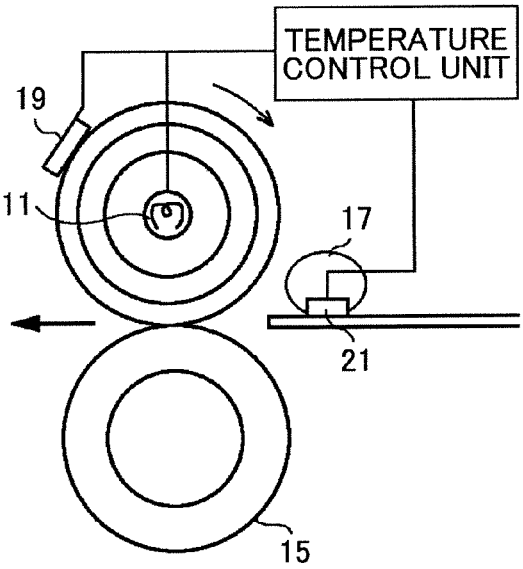
FIG. 6A is a schematic diagram showing the fixing apparatus using a heat roller fixing method, wherein the recording paper P is preliminarily heated by the heater with temperature detecting function.
Figure 6B:
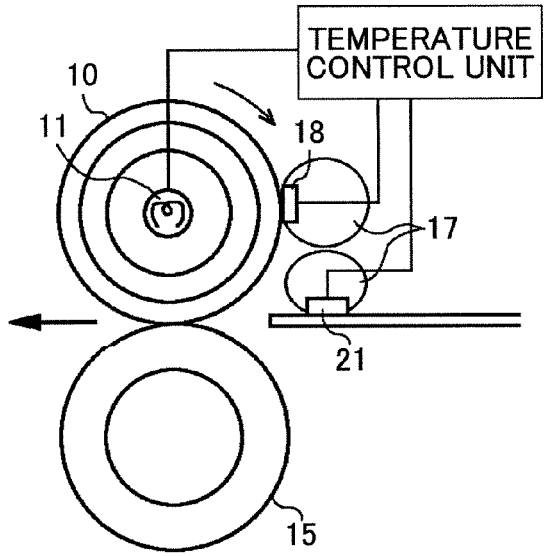
FIG. 6B is a schematic diagram showing the fixing apparatus using the heat roller fixing method, wherein the recording paper P is preliminarily heated by the heater with temperature detecting function.

According to configurations shown in FIGS. 6A, 6B, 6C, and 6D, the recording paper P is pre-heated before reaching the fixing nip by a heater 21 with temperature detecting function, which has the same structure as the heater 18 with temperature detecting function. By pre-heating, the temperature fall of the fixing roller and a fixing belt resulting from the passage of the recording paper P is reduced. In the case of FIG. 6A, the heater 21 with temperature detecting function is used together with the fixing roller 10 that contains the heater 11 of the conventional halogen lamp that is controlled based on the temperature detected by the thermistor 19. FIG. 6B shows the case where the heater 18 with temperature detecting function for controlling the temperature of the fixing roller surface, and the heater 11, which is a halogen lamp in the fixing roller 10, are included in addition to the heater 21 with temperature detecting function; and the heater 11 is turned on and off according to the temperature detected by the heater 18 with temperature detecting function. In this case, too, the temperature can be precisely controlled if the heating control is carried out by dividing the heater 18 into pieces with temperature detecting function as described above. This is highly effective especially when the operating-environment temperature is low, such as in a cold district, and where a temperature fall is notable immediately after warm-up.

Figure 6C:
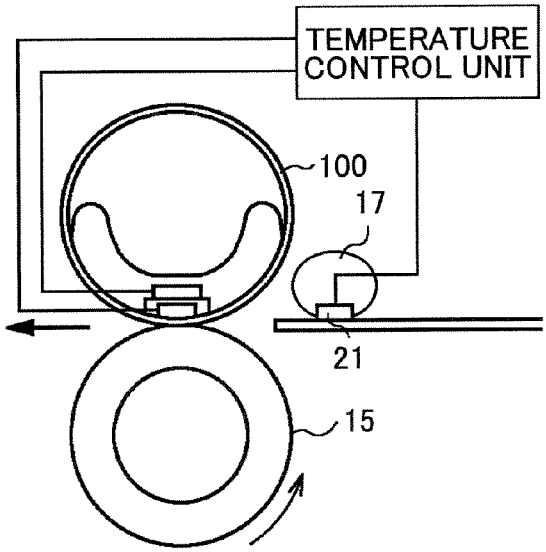
FIG. 6C is a schematic diagram showing the fixing apparatus using a film heating method, wherein the recording paper P is preliminarily heated by the heater with temperature detecting function.
Figure 6D:
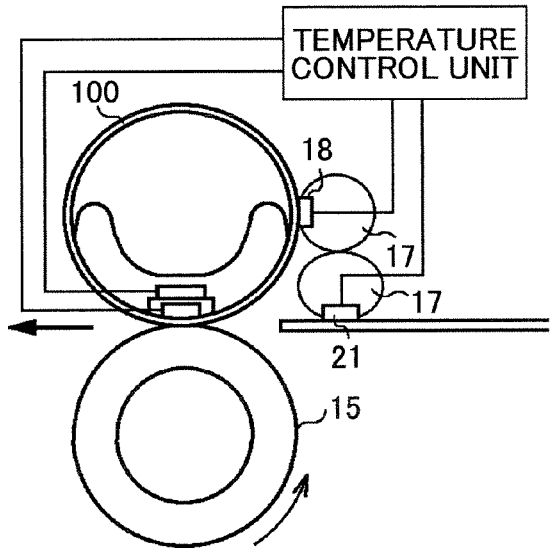
FIG. 6D is a schematic diagram showing the fixing apparatus using the film heating method, wherein the recording paper P is preliminarily heated by the heater with temperature detecting function.

FIGS. 6C and 6D show cases where the film heating method is used. Control of the configurations shown by FIG. 6C and FIG. 6A is the same. Control of the configurations shown by FIG. 6D and FIG. 6B is the same.

FIGS. 7A, 7B, and 7C show the cases wherein a temperature fall of both ends of the pressurization roller 15 when processing the size A paper (refer to dotted lines in FIG. 9), which temperature fall is one of the conventional problems, is prevented by providing a heater 22 with temperature detecting function that has the same structure as the heater 18 with temperature detecting function and by controlling heating the pressurization roller 15. The control is performed in the same way as described above. It is preferred that the heater 22 with temperature detecting function be provided immediately before the nip, that is, on the right-hand side of the pressurization roller as illustrated. FIG. 7A shows the case where the heater 22 with temperature detecting function is used by the fixing unit that includes the conventional halogen lamp 11 and the thermistor 19 for temperature controlling. FIG. 7B shows the case where the halogen lamp 11 is turned on and off based on the temperature detected by the heater 18 with temperature detecting function for heating the fixing unit. FIG. 7C shows the case wherein the film heating method is used. Here, since the temperature of the heater is controlled based on the temperature detected by the heater 18 with temperature detecting function, a thermistor is not used.

The configurations shown by FIGS. 5A, 5B, 5C, 6A, 6B, 6C, 6D, 7A, 7B, and 7C have been described as there being no heater provided in the pressurization roller 15. Nevertheless, the configuration may include a heater and a thermistor. As for the configurations shown by FIGS. 5A, 5B, 5C, 6A, 6B, 6C, and 6D, a thermistor would be required for the pressurization roller 15. As for the configurations shown by FIGS. 7A, 7B, and 7C, temperature can be detected by the heater 22 with temperature detecting function.

Figure 8A:
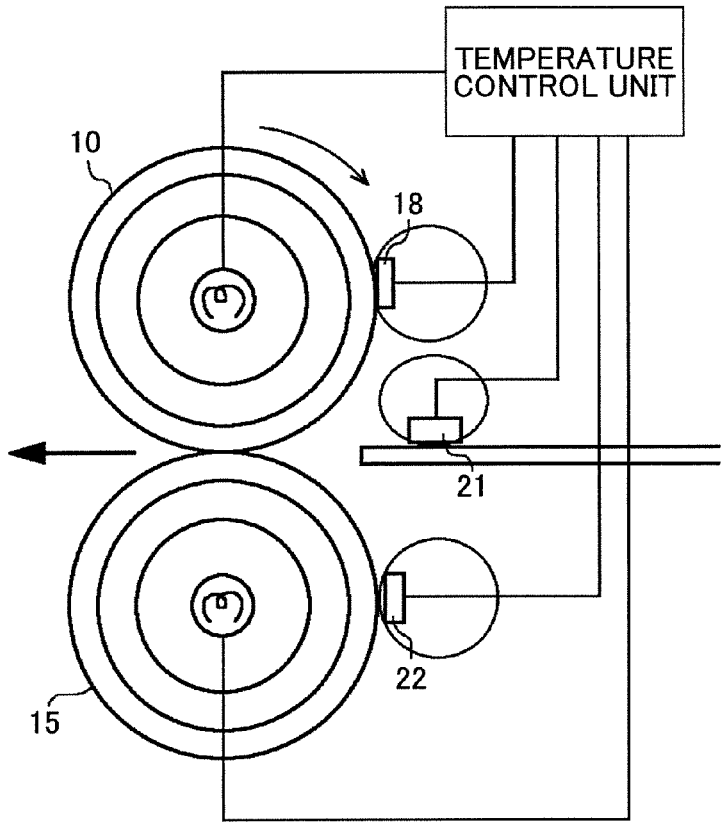
FIG. 8A is a schematic diagram showing the fixing apparatus using the heat roller fixing method, wherein the recording paper P and the pressurization roller are preliminarily heated by a heater with temperature detecting function.
Figure 8B:
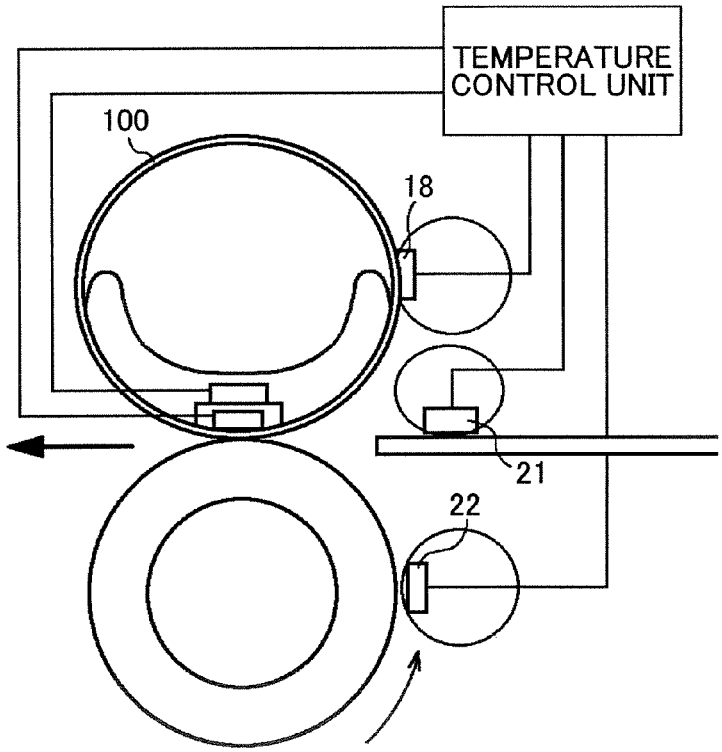
FIG. 8B is a schematic diagram showing the fixing apparatus using the film heating method, wherein the recording paper P and the pressurization roller are preliminarily heated by a heater with temperature detecting function.

FIG. 8A shows a fixing apparatus that includes the heater 18 with temperature detecting function for heating and temperature-controlling the fixing roller 10 that includes the halogen lamp for auxiliary heating, the heater 21 with temperature detecting function for heating and temperature-controlling the recording paper P, and the heater 22 with temperature detecting function for heating and temperature-controlling the pressurization roller 15. FIG. 8B shows the case where the film heating method is used.

Figure 9:
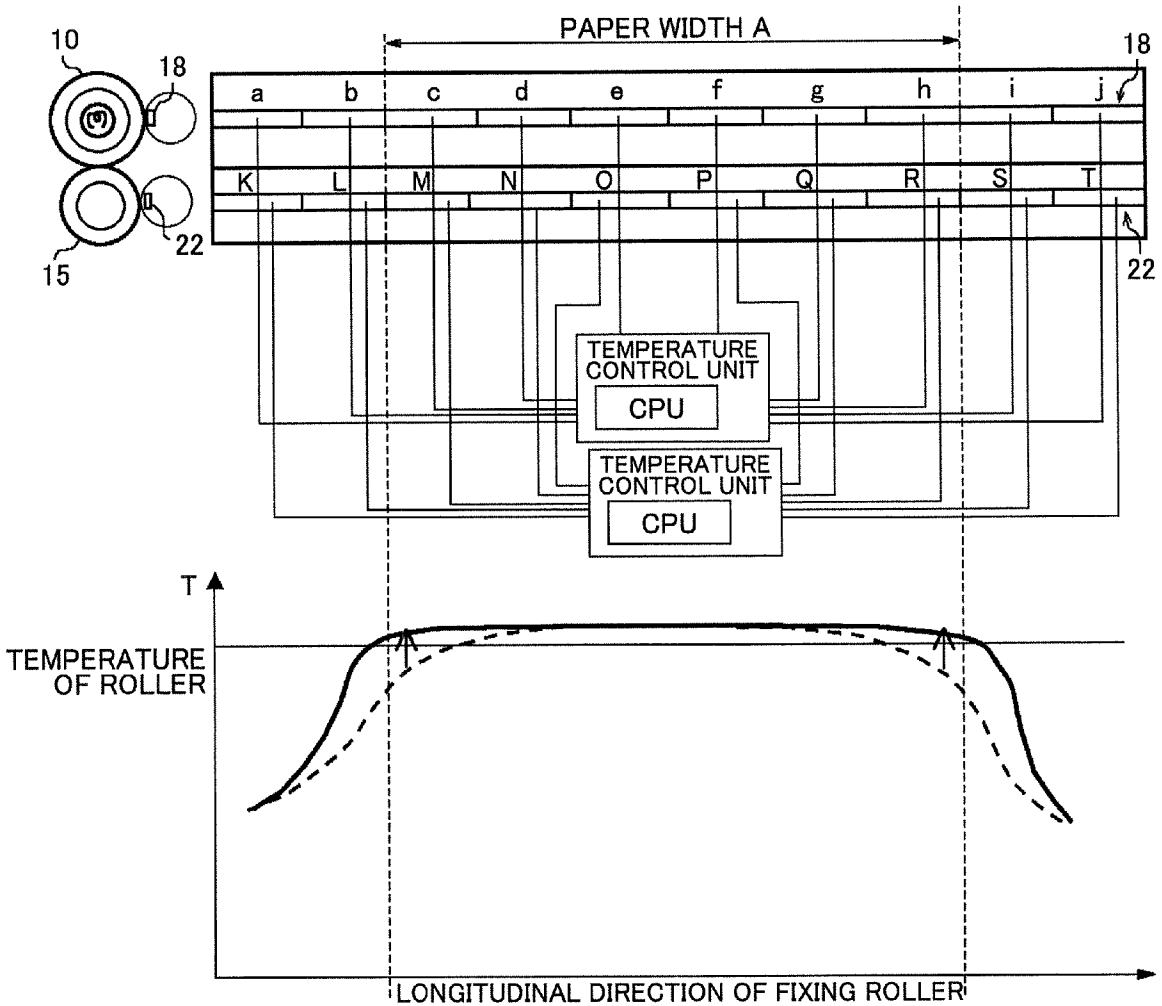
FIG. 9 is a schematic diagram showing the fixing apparatus, wherein a heater with temperature detectors is provided to each of the fixing roller and the pressurization roller, the temperature detectors being arranged in the width directions of the recording paper P.

Further, since the temperature fall of both ends of the pressurization roller 15 can be efficiently controlled by dividing and arranging the heater 18 with temperature detecting function and the heater 22 with temperature detecting function in the longitudinal direction of the pressurization roller 15 as shown in FIG. 9, stable fixing is attained. Further, since heat is applied to only selected exothermic bodies according to the size of the recording paper P, useless heating is avoided. The configuration shown by FIG. 9 can be combined with the configuration shown by FIGS. 8A, and 8B for further stabilized fixing.

Figure 10A:
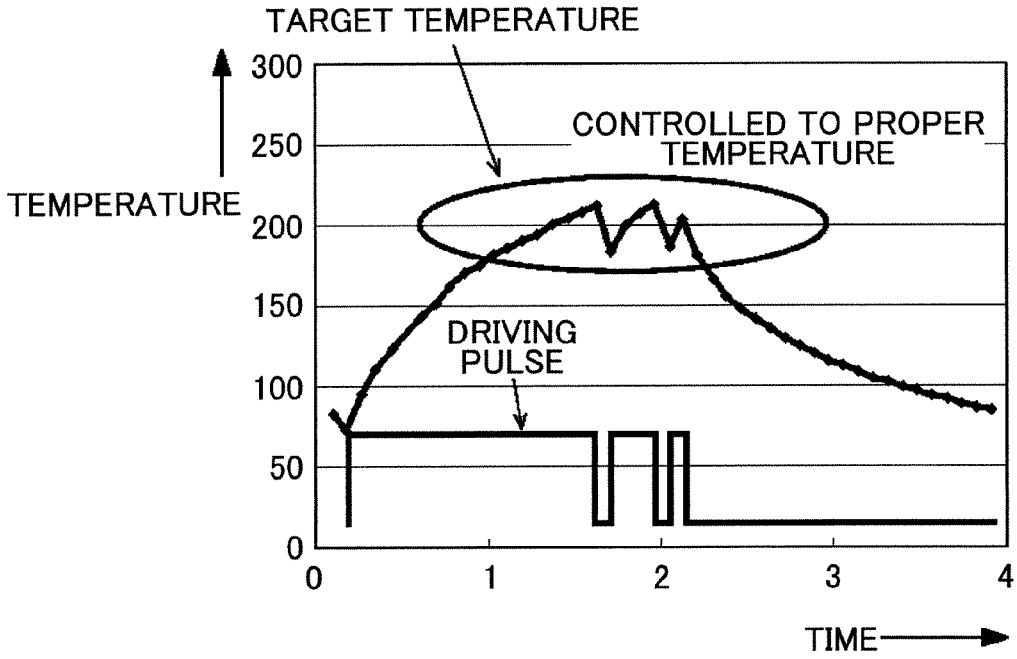
FIG. 10A is a graph showing an example of temperature control according to the present invention.
Figure 10B:
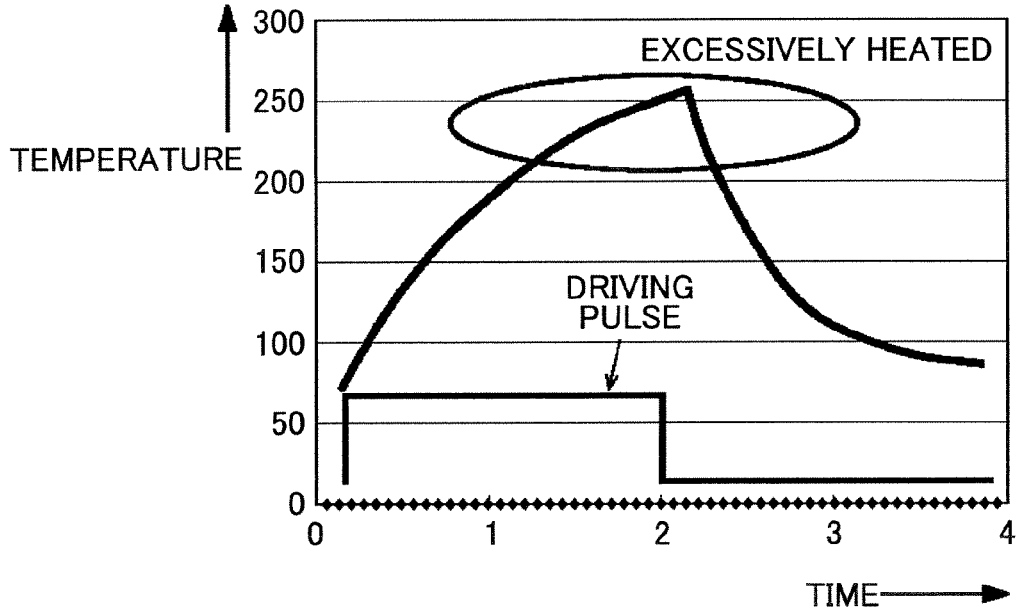
FIG. 10B is a graph showing an example of temperature control according to the conventional method.

Temperature change with time attained by the temperature control according to Embodiments of the present invention using the heater with temperature detecting function is as shown by FIG. 10A. The same according to the conventional method is shown by FIG. 10B. As shown by FIGS. 10A and 10B, the temperature control according to the Embodiments provides improved temperature control as compared with the conventional method.

Figure 11A:
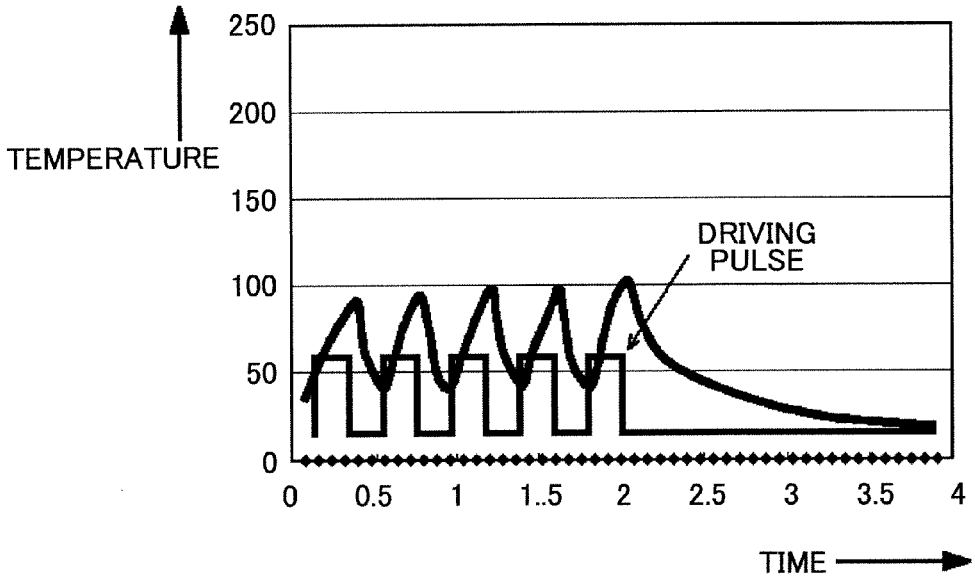
FIG. 11A is a graph showing an example of temperature control according to the present invention.
Figure 11B:
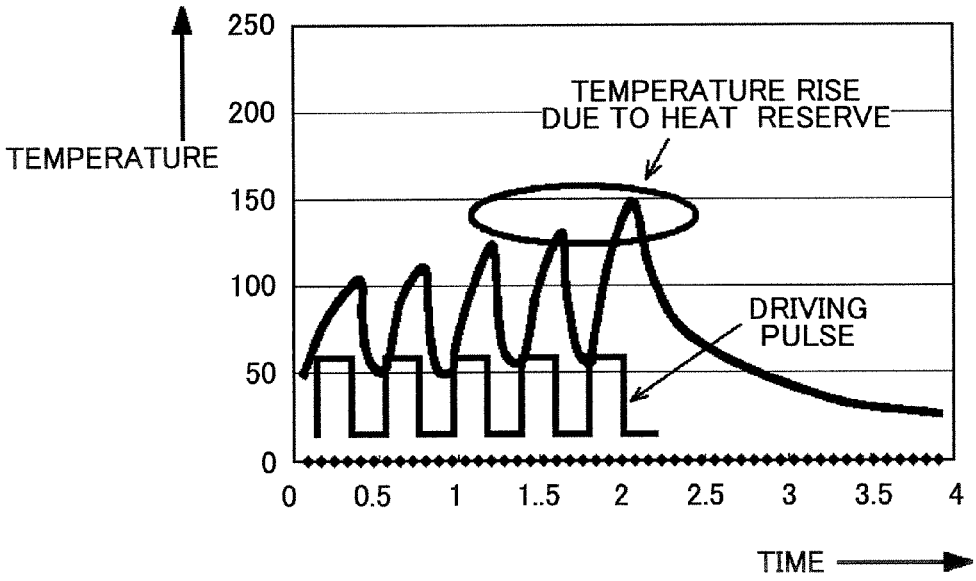
FIG. 11B is a graph showing an example of temperature control according to the conventional method.

Further, examples of the temperature change with time where the heater is driven by pulses according to the present invention and the conventional method are shown in FIGS. 11A and 11B, respectively. According to Embodiments of the present invention, excessive temperature rise is prevented, thereby obtaining proper temperature as shown in FIG. 11A. In comparison, in the case of the conventional method, since there is no temperature control, the temperature is excessively raised due to influence of the heat reserve of the heater.

Further, the present invention is not limited to these embodiments, but variations and modifications may be made without departing from the scope of the present invention.

The present application is based on Japanese Priority Application No. 2005-207062 filed on Jul. 15, 2005 with the Japanese Patent Office, the entire contents of which are hereby incorporated by reference.

What is claimed is:

1. A fixing apparatus, comprising:

a plurality of exothermic bodies with a temperature detecting function which exothermic bodies generate heat with electric current and detect temperature;

a heating unit that includes the exothermic bodies with the temperature detecting function;

a film, a surface of which slides on the heating unit;

a thermal fixing unit for heating and fusing a toner image by heat provided by the heating unit through the film at a predetermined fixing temperature, the toner image being yet-to-be-fixed and placed on a recording paper;

a pressurization unit for pressing the recording paper to the thermal fixing unit; and a temperature control unit for controlling a temperature of each of the exothermic bodies to be a predetermined temperature based on the temperature of the corresponding exothermic body detected by the corresponding exothermic body with the temperature detecting function.

2. The fixing apparatus as claimed in claim 1, further comprising:

an auxiliary heating unit for heating the thermal fixing unit in addition to the heating unit.

3. The fixing apparatus as claimed in claim 2, wherein a temperature of the auxiliary heating unit is controlled to be another predetermined temperature based on the temperature of another exothermic body detected by the other exothermic body with the temperature detecting function.

4. The fixing apparatus as claimed in claim 1, wherein the temperature of each of the exothermic bodies with the temperature detecting function is controlled to be the predetermined temperature according to a width of the recording paper.

5. The fixing apparatus as claimed in claim 2, wherein the temperature of each of the exothermic bodies with the temperature detecting function is controlled to be the predetermined temperature according to a width of the recording paper.

6. The fixing apparatus as claimed in claim 3, wherein the temperature of each of the exothermic bodies with the temperature detecting function is controlled to be the predetermined temperature according to a width of the recording paper.

7. The fixing apparatus as claimed in claim 1, wherein the temperature control unit for controlling the temperature of each of the exothermic bodies to be the predetermined temperature based on the temperature of the corresponding exothermic body detected by the corresponding exothermic body with the temperature detecting function comprises:

a drive circuit for providing electric current to the exothermic bodies with the temperature detecting function;

a control circuit for switching the electric current provided to each of the exothermic bodies between energizing the corresponding exothermic body and detecting the temperature of the corresponding exothermic body;

a voltage detection circuit for converting a temperature value of each of the exothermic bodies into a voltage value based on the current provided to the corresponding exothermic body when detecting the temperature;

an analog-to-digital conversion circuit for converting the voltage value into a digital value; and a comparator for comparing the digital value with a predetermined value.

8. The fixing apparatus as claimed in claim 1, wherein the temperature control unit for controlling the temperature of each of the exothermic bodies to be the predetermined temperature based on the temperature of the corresponding exothermic body detected by the corresponding exothermic body with the temperature detecting function comprises:

a drive circuit for providing electric current to the exothermic bodies with the temperature detecting function;

a control circuit for switching the electric current provided to each of the exothermic bodies between energizing the corresponding exothermic body and detecting the temperature of the corresponding exothermic body;

a voltage detection circuit for converting a temperature value of each of the exothermic bodies into a voltage value based on the current provided to the corresponding exothermic body when detecting the temperature;

an analog-to-digital conversion circuit for converting the voltage value into a digital value;

an integrator for integrating the digital value from a starting time of heating; and a comparator for comparing the integrated digital value with a predetermined value.

9. An image formation apparatus, comprising the fixing apparatus as described in claim 1.

* * * * *